United States Patent [19]

Hunter

[11] Patent Number: 4,967,501

[45] Date of Patent: Nov. 6, 1990

[54] SIMULTANEOUS FIVE SHOT SINGLE ACTION PISTOL

[76] Inventor: Gary R. Hunter, 2530 Oak Grove Pl., Toledo, Ohio 43613-3347

[21] Appl. No.: 484,816

[22] Filed: Feb. 26, 1990

[51] Int. Cl.[5] ..... F41A 19/18

[52] U.S. Cl. ..... 42/69.01; 42/8; 42/76.01

[58] Field of Search ..... 42/8, 69.01, 76.01

[56] References Cited

U.S. PATENT DOCUMENTS

| | | | |
|---|---|---|---|
| Re. 1,199 | 6/1981 | Sharps . | |
| 50,232 | 10/1865 | Elliot . | |
| 239,662 | 4/1881 | Martin . | |
| 368,924 | 8/1887 | Krieger . | |
| 1,772,227 | 8/1930 | Revelli . | |
| 3,193,960 | 7/1965 | Stevens, Jr. . | |
| 3,352,046 | 11/1967 | Warner et al. . | |
| 3,597,870 | 8/1971 | Block | 42/42.01 |
| 3,950,875 | 4/1976 | Hirschfeld | 42/42.01 |
| 4,400,900 | 8/1983 | Hillberg et al. . | |
| 4,407,085 | 10/1983 | Hillberg et al. . | |
| 4,416,078 | 11/1983 | Hillberg . | |
| 4,424,638 | 1/1984 | Hillberg . | |
| 4,625,443 | 12/1986 | Beretta . | |
| 4,722,148 | 2/1988 | Walker . | |

*Primary Examiner*—Charles T. Jordan
*Assistant Examiner*—Richard W. Wendtland

[57] ABSTRACT

Thus a simultaneous five shot single action piston is disclosed. A one piece receiver containing a minimum of five working parts of simple design and strong structural rigidity entailing a firing pin, cocking hammer, sear, plunger, and trigger make up the provided assembly of a new concept in .22 caliber hand guns not existing in present equivalence or prior art. Provided is an economical utility hand gun of high quality serving many purposes and creating a new market potential for the United States Economy.

2 Claims, 4 Drawing Sheets

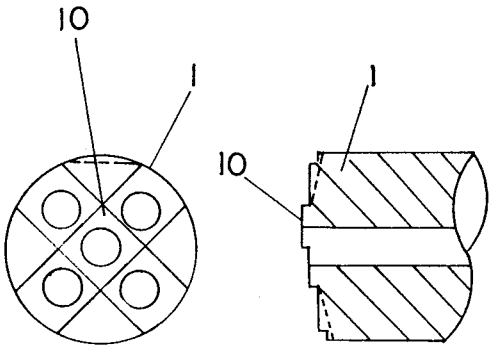
FIG-6
FIG-7
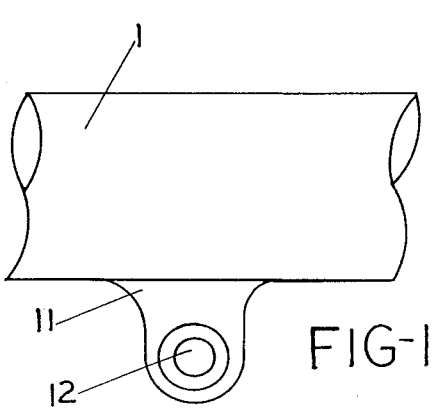
FIG-10
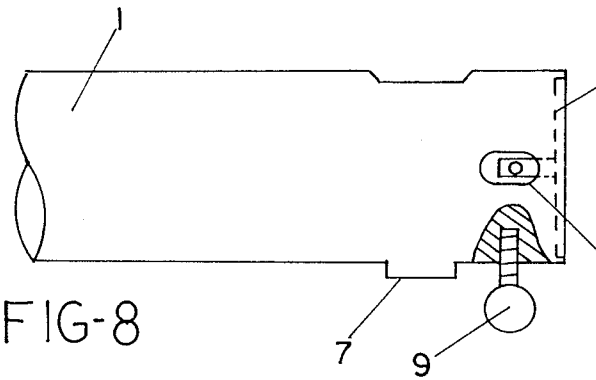
FIG-8
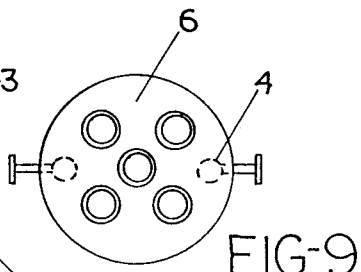
FIG-9

SIMULTANEOUS FIVE SHOT SINGLE ACTION PISTOL

BACKGROUND OF INVENTION

The primary objective of this invention is to provide a special high quality firearm of greater capability in its class, and a much lower cost in manufacturing processes as compared to other conventional quality .22 caliber hand guns. A strong feature over any and all prior art is the fact that it can deliver five simultaneously fired rounds to a long range target with extraordinary accuracy, thus producing much higher game getting results beyond typical capabilities of other .22 caliber hand guns. Other features will become apparent to those skilled in the art in the following summary of the new invention.

FIELD OF INVENTION

This invention applies to the sporting class of commercially manufactured firearms.

DESCRIPTION OF PRIOR ART

Specific problems that this invention solves over prior art is its ability to deliver five shots at one time. Its selection of simple internal parts which comprises its working mechanism, makes assembly and take down procedures for cleaning or parts replacement extremely simple. Thus manufacturing processes are greatly eased and the primary factor of cost to manufacture high quality, turns towards high end gain potential.

SUMMARY OF INVENTION

This invention incorporates two main embodiments, comprised of a barrel containing five independent chamberings for the .22 caliber long rifle cartridge, and a one piece receiver containing only five moving parts. Its primary advantage over prior art remains in its simplicity of manufacture and extensive elimination of unnecessary parts and sub assembles not directly associated with the functional discharging of the firearm. Final features over prior existing art is the ease of assembly and repair that any person unskilled in repair or knowledge of firearms could easily master.

DESCRIPTION OF DRAWINGS

FIG. 6. Is a enlarged Fragmentary View of the barrel showing five separate surfaces.

FIG. 7. Is an Enlarged Side View of the front of the barrel showing the different frontal surface elevations.

FIG. 8. Is an Enlarged Side View of the rear of the barrel showing the ball locking device as it is attached to the bottom of the barrel along with the slots and counter bored surface for the extractor.

FIG. 9. Is an Enlarged Side View of the rear of the barrel showing the extractor.

FIG. 10. Is an Enlarged Side View of the barrel showing the swivel fulcrum for opening and attaching the barrel to the receiver.

DESCRIPTION OF THE PREFERRED EMBODIMENTS

Figure 1:
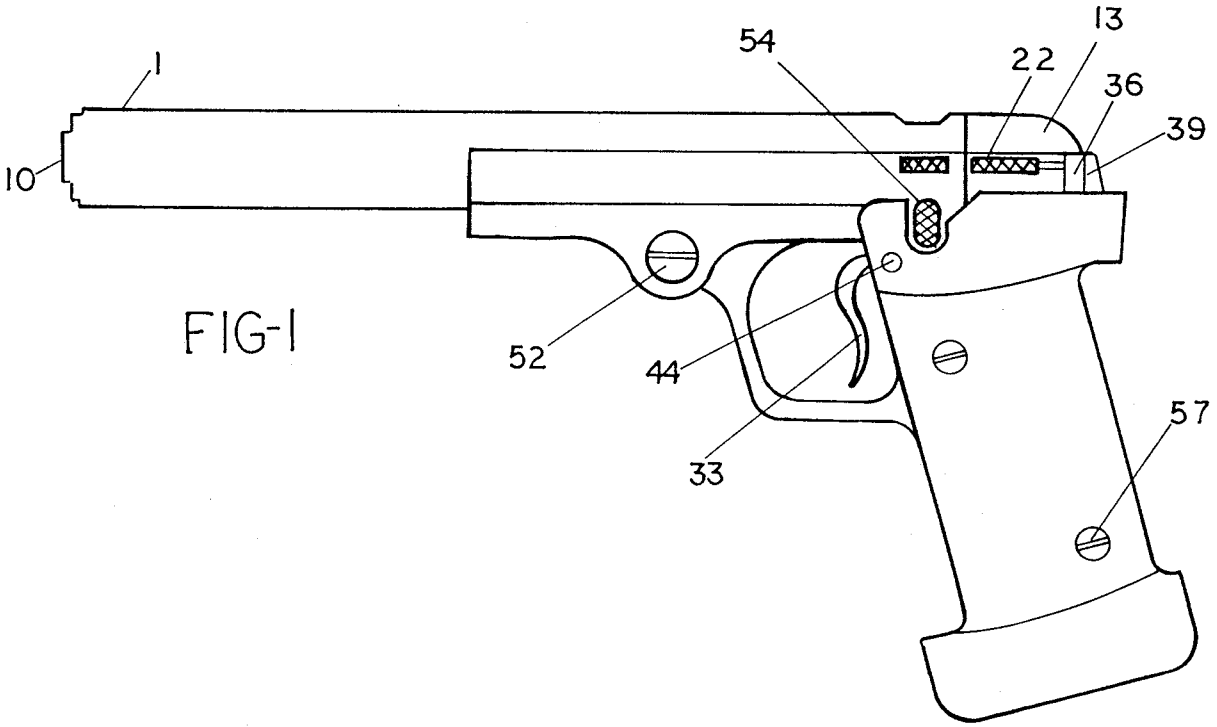
FIG. 1. Is an Elevation view of the SIMULTANEOUS FIVE SHOT SINGLE ACTION PISTOL according to the present invention.
Figure 2:
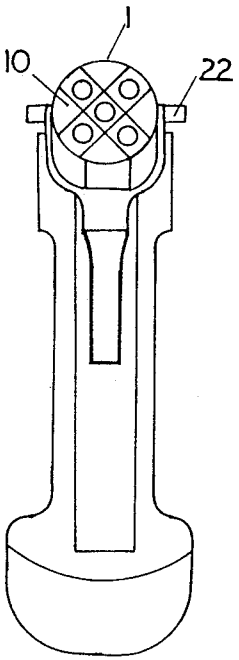
FIG. 2. Is a Frontal View of the pistol showing the five .22 caliber bores contained in one barrel structure.
Figure 3:
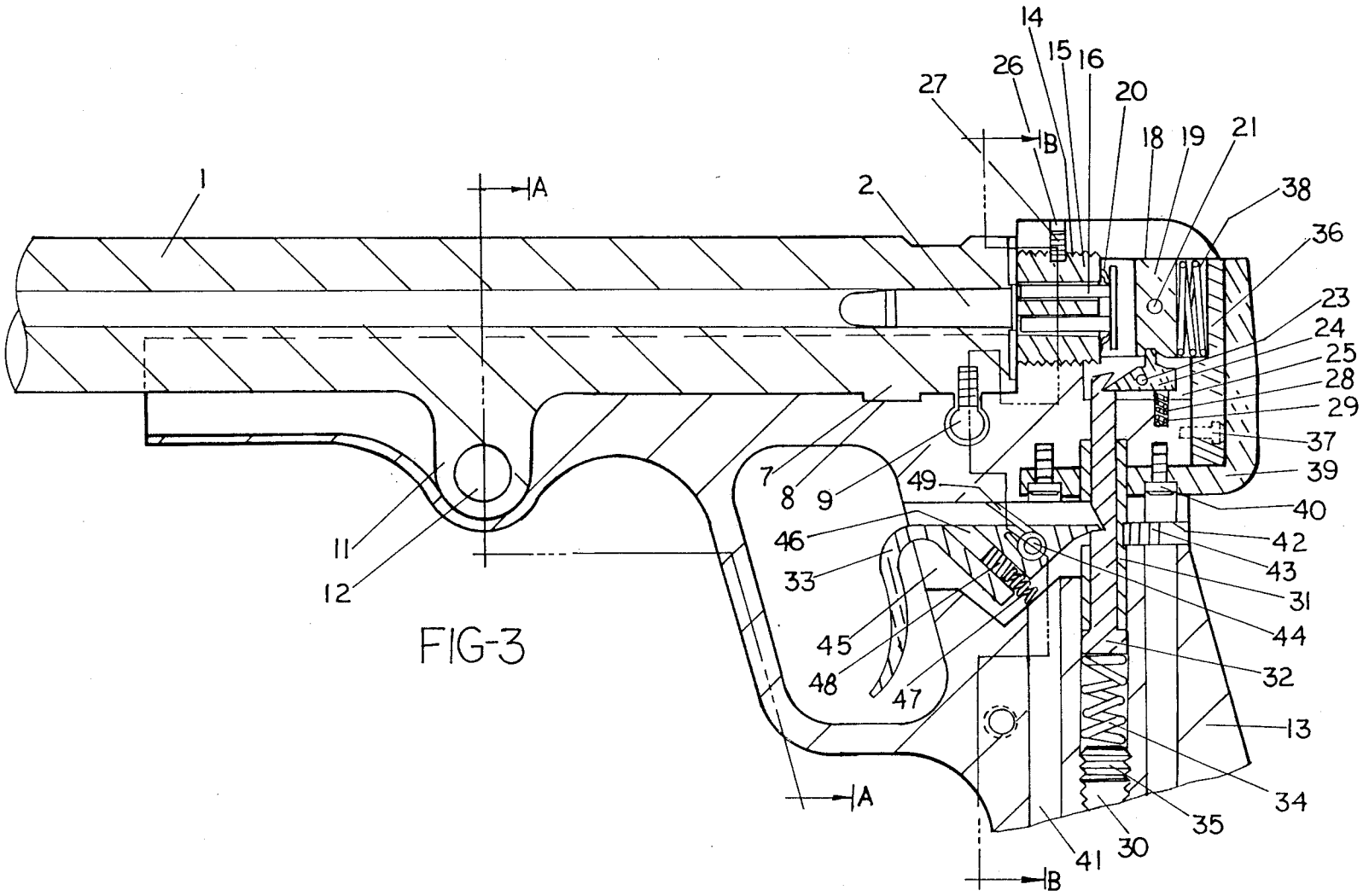
FIG. 3. Is an Enlarged Sectional Fragmentary Elevation View showing the method of fastening the barrel to the one piece receiver, the trigger mechanism, with plunger, sear, hammer block, firing pin retainer, firing pin, with springs.
Figure 4:
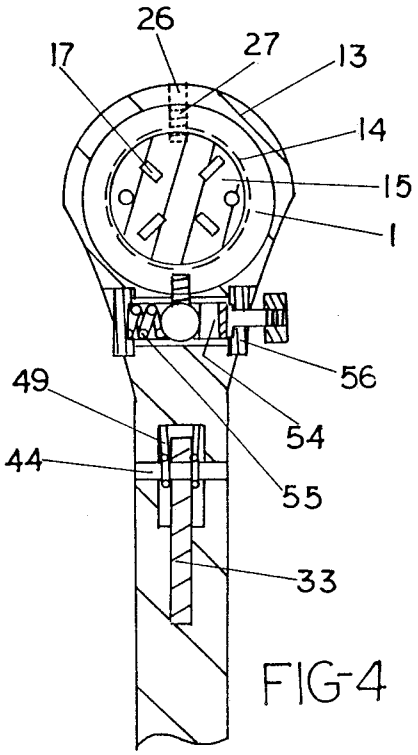
FIG. 4. Is a Fragmentary Sectional View taken from line B of FIG. 3, showing how the firing pin retainer and firing pin are fastened to the receiver, further showing the spring loaded ball lock, barrel opening, and release mechanism.

Refering to the drawings in detail wherein like numerals designate like parts, a SIMULTANEOUS FIVE SHOT SINGLE ACTION PISTOL, according to the invention consists of a barrel -1- having five .22 caliber chambers at its rear -2-, FIG. 3, with counter bored hole -3- at its rear having two holes -4- and two slots -5- milled in its sides at the rear to accept extractor -6-, FIGS. 8–9. A lug -7-, FIG. 8, is machined on the rear bottom surface of the barrel -1- to fit in the receiver groove -8-,FIG. 3, with small threaded ball -9- threaded into its rear under side FIG. 8. Five surfaces -10- are ground at different elevations, FIG. 7. An ear like swivel -11- is machined into its mid section having a hole -12- reamed through it, FIG. 10. A receiver consisting of one piece -13- has a large threaded hole -14-, FIG. 4, threaded into it to accept a firing pin retainer -15-,FIG. 4. A floating firing pin -16-, FIG. 3, slides into four machined grooves -17- contained in the firing pin retainer -15-FIG. 4 A smaller hole -18-,FIG. 3, is reamed through receiver -13- to accept cocking block -19- and spring -20-,FIG. 3. A cross hole -21-is tapped through cocking block -19- to accept cocking handle -22-FIG. 1-2. A hole -23-is reamed through receiver -13- at its rear,FIG. 3, serving to act as a pivot point for sear -24- FIG. 3. A clearance hole -25- is milled into receiver -13- to allow sear -24- to fulcrum and allow cocking block -19- to move forward and strike floating firing pin -16-,FIG. 3. A small hole -26- is tapped from the top of receiver -13- to accept set screw -27- to hold firing pin retainer -15- in location, FIG. 3. A small hole -28- is formed into the receiver -13- to accept a small sear return spring -29- to press up against sear -24- during cocking,FIG. 3. A partially reamed and threaded hole -30- is machined into pistol grip of the receiver -13-,FIG. 3. A guide bushing -31- is press fit into the hole -30- to accept trigger release actuating plunger -32-which engages trigger -33- and sear -24-,FIG. 3. A spring -34- followed by an adjusting set screw -35- regulates tension on the trigger plunger -32-FIG. 3. A back plate -36- is fastened to receiver -13- by two cap screws -37- behind cocking spring -38- serving to retain cocking block -19- in receiver -13-, FIG. 3. A safety retainer -39- is fastened to receiver -13- by two socket head cap screws -40- threaded into receiver -13- through clearance holes -41- drilled into receiver -13- from bottom of pistol grip FIG. 3. A threaded hole -42- is tapped into rear of receiver -13- where set screw -43- holds guide bushing -31- FIG. 3. Trigger -33- fulcrums on trigger pin -44- inside of clearance cavity -45- to allow disengagement from trigger plunger -32-,FIG. 3. A small hole -46- is tapped through trigger -33- at an angle to accept backlash spring -47- and backlash set screw -48-, FIG. 3.

Figure 5:
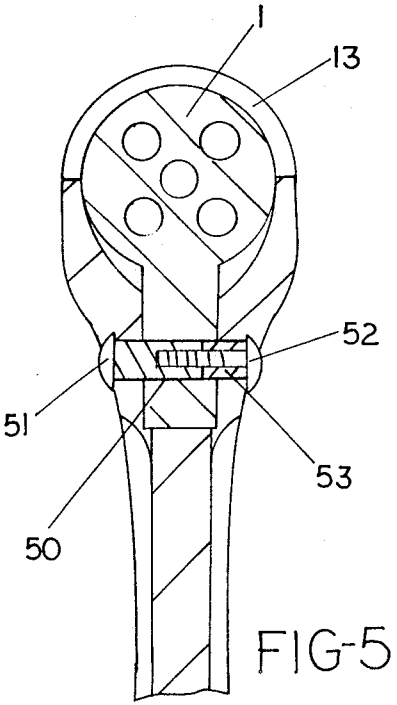
FIG. 5. Is an Enlarged Fragmentary View taken from line A of FIG. 3, showing how barrel opens on the swivel pivot point.

A high tension spring -49- is attached to trigger -33- and fulcrums on trigger pin -4-4, FIG. 3. A hole -50- is reamed into receiver -13- at the front to accept swivel pin -51-, FIG. 5. Swivel pin -51- is secured and held through receiver -13- and barrel -1- by screw -52-,FIG. Spacer -53- takes up slack of screw -52- when tightening. The barrel -1- is locked into firing position by button catch -54-, FIG. 4. Button catch -54- is held ito position by spring -55-,FIG. 4. Button catch assembly is retained by two machined set screws -56- tapped into receiver -13- from both sides, FIG. 4. Micarta pistol grips are fastened to receiver -13- by screws -57-,FIG. 1.

The terms and expressions which have been employed herein are used as terms of description and not of limitation, and there is no intention in the use of such terms and expressions, of excluding any equivalents of the features shown and described or portions thereof but it is recognized that various modifications are possible within the scope of the invention claimed.

What is claimed is:

1. A simultaneous five shot single pistol comprising a barrel, a tripping mechanism, and a housing, said barrel having five projectile bores arranged in a die pattern, each projectile bore having a different length and being dischargeable by said tripping mechanism contained within said housing, said tripping mechanism including a firing pin having four elongated rectangular extremities connected to a circular flat disc so as to form a single fork like structure, said firing pin horizontally sliding through a cylindrical retainer having a center section with four rectangular holes, said firing pin being biased away from said retainer by a circular spring, a cylindrical hammer having a flat front, a flat rear, and a side with a notch, said firing pin being engageable by said flat front, said hammer being biased toward said firing pin by a first coil spring at said flat rear, said hammer at said notch being engaged by a protruding shoulder of a sear, said sear having a wedge like front side and a flat bottom side pressing down against a retention spring, a vertically positioned inverted tee shaped plunger having a notched top, a notched mid-section, and a bottom forming a base, said plunger being biased upwardly by a second coil spring at said base, said plunger engaging said wedge at said notched top, said notched mid-section being engaged by a trigger whereby when said trigger is pulled said spring biased plunger is urged upwardly rotating said sear, releasing said spring biased hammer, and striking said firing pin.

2. A simultaneous five shot angle action pistol as defined in claim 1 wherein said housing comprises a single piece having a vertically oriented central bore containing said plunger and said second coil spring, adjacent said central bore a first cavity containing said trigger, above said central bore a second cavity containing said sear and said retention spring, and above said second cavity a horizontally oriented bore containing said first coil spring, said hammer, said firing pin, said circular spring, and said cylindrical retainer.

* * * * *